United States Patent [19]

Nakamura et al.

[11] Patent Number: 4,785,871

[45] Date of Patent: Nov. 22, 1988

[54] MANUFACTURING METHOD FOR HOLLOW CAST PRODUCT WITH BOTTOM

[75] Inventors: Shiro Nakamura, Ashiya; Katsuya Inoue, Aichi, both, Japan; Friedrich Werner, Krefeld; Franz E. Schilling, Kemper, both of Fed. Rep. of Germany

[73] Assignee: Kubota Ltd., Osaka, Japan

[21] Appl. No.: 112,963

[22] Filed: Oct. 27, 1987

Related U.S. Application Data

[62] Division of Ser. No. 909,059, Sep. 18, 1986, Pat. No. 4,729,419.

[30] Foreign Application Priority Data

Dec. 18, 1985 [JP] Japan ..... 60-286339

[51] Int. Cl.[4] ..... B22D 27/04

[52] U.S. Cl. ..... 164/122; 164/122.1; 164/128; 164/354; 164/355

[58] Field of Search ..... 164/122, 122.1, 127, 164/128, 119, 23, 348, 354, 355, 356

[56] References Cited

U.S. PATENT DOCUMENTS

| | | |
|---|---|---|
| 218,815 | 7/1879 | Oliver . |
| 1,524,391 | 1/1925 | Durham . |
| 2,253,903 | 8/1941 | Hagemeyer . |
| 2,377,731 | 6/1945 | Walcher . |
| 3,927,855 | 12/1975 | Kleinhagauer . |
| 4,291,747 | 9/1981 | Sevastakis . |

FOREIGN PATENT DOCUMENTS

| | | |
|---|---|---|
| 3216327 | 5/1983 | Fed. Rep. of Germany . |
| 3120221 | 7/1983 | Fed. Rep. of Germany . |
| 39-2204 | 4/1964 | Japan . |
| 58-5739 | 1/1983 | Japan . |
| 72641 | 4/1985 | Japan ..... 164/128 |
| 605683 | 4/1978 | U.S.S.R. . |

*Primary Examiner*—Nicholas P. Godici
*Assistant Examiner*—Samuel M. Heinrich
*Attorney, Agent, or Firm*—Armstrong, Nikaido, Marmelstein & Kubovcik

[57] ABSTRACT

A static casting method for a hollow cast product using a mold with bottom comprising a top lid, a core and an outer mold section, the core being attached to the top lid and disposed inside the outer mold section. The outer mold section includes a lateral mold section and a lower mold section. The lateral mold section is formed at its inner peripheral wall portion with a composite cooling section by stacking chiller blocks and interposing therebetween refractory sands and at its outer wall portion with refractory sands. Cooling pipes include first and second pipes. A first pipe extends longitudinally through the refractory sands at the outer wall portion and a second pipe extends longitudinally through the inner wall portion in contact with at least a part of each of the chiller blocks, the first and second pipes being connected at their lower portions through the bend portion. The chiller blocks are cooled by water flowing in the second pipes. The entire casting cavity is first filled with molten metal. Then cooling water is passed through the cooling pipes until solidification of the metal is complete. Thereafter the supply of water is stopped and water remaining in the pipes is discharged.

7 Claims, 3 Drawing Sheets

MANUFACTURING METHOD FOR HOLLOW CAST PRODUCT WITH BOTTOM

This is a division of application Ser. No. 909,059 filed Sept. 18, 1986, now U.S. Pat. No. 4,729,419.

FIELD IN THE INDUSTRIAL APPLICATION

The present invention relates to a static casting mold provided with cooling means, which is used for casting cast-iron material into a hollow product with bottom, and also to a static casting method by the use of said mold.

PRIOR ART

Heretofore, a large-sized, close-ended and hollow cast product of cast-iron material has been manufactured by using static sand molds, but the products are not satisfactory in that the metallic structure is not uniform all over the entire thickness or wall portion of the products. That is, a relatively good structure is obtained in the surface layer portion of the cast product where molten metal comes into contact with a sand mold, while particularly in the midpoint of the wall portion the graphite structure is degraded to lead to the product having non-uniform mechanical properties because cooling speed of molten metal decreases as distance from the sand mold becomes larger, resulting in that longer time is required for solidification.

Accordingly, the present inventors have considered if it is possible to utilize the static mold for casting a close-ended hollow steel ingot disclosed in the Japanese Examined Patent Application No. SHO. 58-5739. The reason is that this mold is provided at the core section with forced cooling means and has the outer mold section made of metal, and that this mold is thus considered to be effective in increasing the cooling speed of molten metal.

However, when the proposed static mold is applied for casting cast-iron material into the products, there occurred the defect of the products being cracked. This is believed to be due to the fact that the outer mold section made of metal is melted and lost at the inner surface thereof by molten metal during casting, resulting in that the molten metal enters into the melt-lost portion of the outer mold section and is solidified therein. In particular, the solidified cast-iron material shrinks as the temperature decreases while the outer mold section thermally extends by the heat of molten metal. However, movements of shrinking and extending are restricted to each other, leading to occurrence of cracks on the products.

The present invention has been accomplished in view of the problems mentioned in the above.

SUMMARY OF THE INVENTION

An object of the present invention is to provide a static mold for casting cast-iron material into hollow cast products with bottom, especially large-sized products, wherein the mold is capable of rapidly cooling the wall midpoint portion of the products without causing cracks.

Another object of the present invention is to provide a static mold for casting cast-iron material into hollow cast products with bottom, wherein the mold comprises an outer mold section and a core provided within the outer mold section, the outer mold section being formed at the inner lateral wall surface thereof by stacking chiller blocks and interposing therebetween refractory layers so as to allow thermal expansion of the chiller blocks and being provided with cooling pipes which come into contact with at least a part of the chiller blocks.

A further object of the present invention is to provide a casting method by the use of aforesaid mold wherein the product can be cast without causing cracks, even if the surface portion and wall midpoint portion of the product are cooled fast.

DETAILED DESCRIPTION OF THE INVENTION

Figure 1:
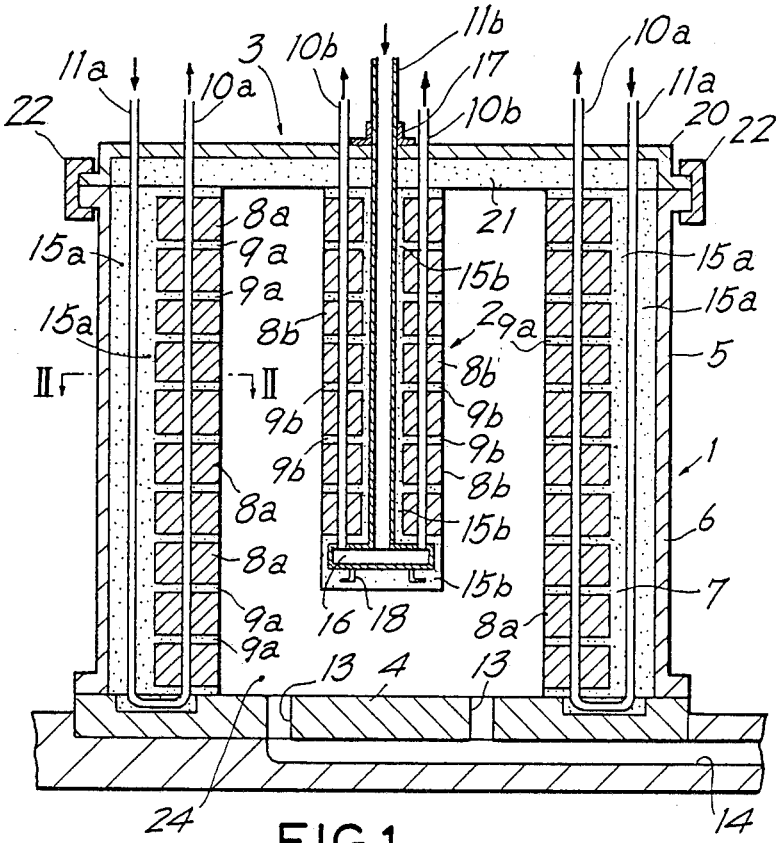
FIG. 1 is a sectional view showing one embodiment of a static casting mold according to the present invention.

The present invention will be explained in detail with reference to FIG. 1 showing an embodiment of a static casting mold.

The static mold in this embodiment comprises an outer mold section 1, a core 2, and a top lid 3. The outer mold section 1 comprises a lower mold section 4 and a lateral mold section 5. The core 2 is suspended from the top lid 3 to be positioned inside the outer mold section 1.

The lateral mold section 5 comprises a metal frame 6 and a composite cooling section 7 formed on the inner peripheral surface thereof, the inner surface of the composite cooling section 7 serving to form the outer lateral surface of a product to be cast.

The composite cooling section 7 is formed at the inner peripheral wall surface with numbers of stacked chiller blocks 8*a* which have refractory sands interposed therebetween, vertically and horizontally. The sand layers 9*a*, which are provided for the purpose of allowing thermal expansion of the chiller blocks 8*a*, are preferable to utilize refractory sands having high thermal conductivity, for example, chromite sand, zircon sand or the like.

Figure 2:
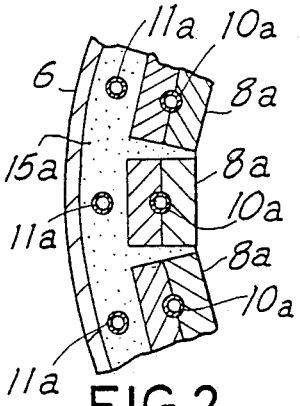
FIG. 2 is a sectional view taken along a line II—II of FIG. 1.

The chiller block 8*a* is formed usually of cast iron material and is in the form of a rectangular solid shape of split construction, as shown in FIG. 2. Further, a cooling pipe 10*a* is held in the midpoint portion of each of stacked chiller blocks 8*a* and extends longitudinally through the chiller blocks 8a. A cooling pipe includes pipe 10a and pipe 11a. A pipe 10a is used for cooling the chiller blocks 8a by flowing water therein and extends from the outside through the top lid 3, and is connected through a U-shaped bend positioned in a recess formed in the upper portion of the lower mold section 4, to a pipe 11a which descends through a sand section 15a in the rear of the chiller blocks 8a. It whould be understood that the pipe 11a may extend through the metal frame 6.

Figure 3:
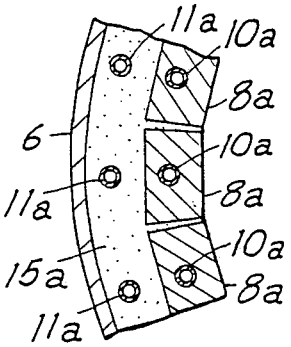
FIGS. 3 and 4 are sectional views showing other embodiments of an outer mold shown in FIG. 2.
Figure 4:
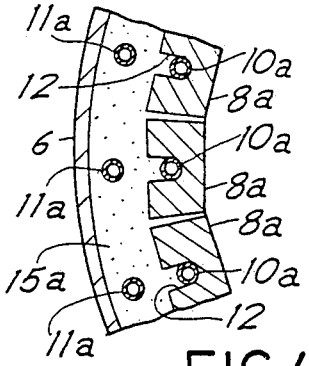

In this respect, copper is suitable as the material for the pipes 10a and 11a because of their heat resistivity and also their workability for pipings. Further, the shape of the chiller blocks is not limited to the split structure shown in FIG. 2, but may be the integral structure having trapezoidal shape in cross-section, as shown in FIG. 3. Further, each of the pipes 10a may be held in U-shaped recess of the chiller blocks 8a, as shown in FIG. 4. The chiller block may be formed at the surface opposed to a mold cavity 24 into an arcuate or other suitable shapes in accordance with the outer shape of the product. The sand section 15a disposed between the metal frame 6 and the chiller blocks 8a is not limited to chromite sand or the like having high thermal conductivity but may be silica sand or the like.

The lower mold section 4 is made of a thick-walled cast iron plate and formed with an upwardly directed sprue 13 extending therethrough and communicating with a runner 14.

Figure 7:
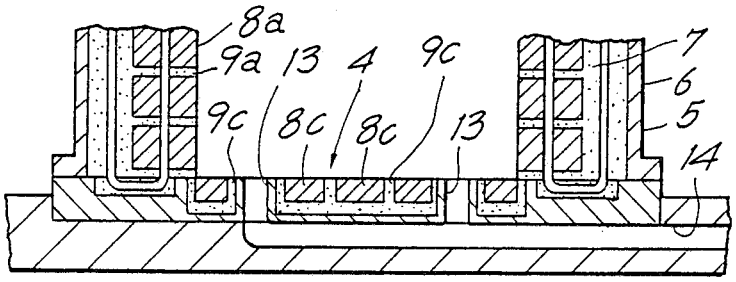
FIG. 7 is a sectional view showing another embodiment of a lower mold section.

In this embodiment, the lower mold section 4 has been shown as formed of a cast iron plate, but it is not limited thereto. As shown in FIG. 7, the lower mold section may be in the form of the chiller blocks 8c laid on its upper portion with refractory sand 9c interposed therebetween, thus increasing the cooling effect on the bottom molten metal.

The core 2 is suspended from the top lid 3 to be positioned inside the outer mold section 1 and is provided at the central portion thereof with a first pipe 11b of which lower end is further provided with branch portion 16 in the form of hollow disk. The first pipe 11b is provided at the upper portion thereof with a fixed flange 17, by which the core 2 is attached to the top lid 3.

Chiller blocks 8b are stacked over the upper surface of the branch portion 16 to from the peripheral lateral surface of the core 2. Second pipes 10b extend through the top lid 3 and then through the stacks of chiller blocks 8b, and are connected to the upper surface of the branch portion 16, thus communicating with the first pipe 11b. The second pipes 10b are used for cooling the chiller blocks 8b by flowing water in the pieps. The first pipe 11b is formed of a pipe material having high strength such as a steel pipe in order to support the total load of the chiller blocks 8b, sand layers 9b and sand section 15b provided around the chiller blocks 8b and around the outer periphery of the branch portion 16. On the other hand, a copper pipe is suitable for the second cooling pipe 10b because of workability of pipings. In addition, ribs 18 are provided for fixing the refractory sand.

Figure 5:
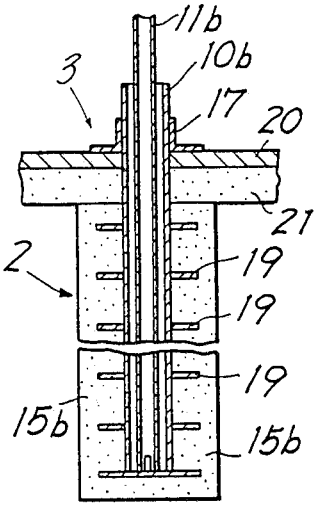
FIG. 5 is a sectional view showing another embodiment of a core.

FIG. 5 shows another embodiment of a core. A first pipe 11b is contained in a second pipe 10b which is provided at the outer periphery thereof with appropriate numbers of cooling fins extending outward. Further, the fins 19 also serve to make it easier for sand section 15b to stick to the outer periphery of the second pipe 10b. A fixed flange 17 is attached to the second pipe 10b for fixing the core to the top lid 3. The second pipe 10b is used for cooling the sand section by flowing water therein.

The top lid 3 comprises an outer plate 20 made of steel or the like, and sand section 21 of silica sand or other sands formed on the inner surface of the outer plate 20, the load of the core 2 being supported by the outer plate 20. The buoyant force acting on the core after molten metal has been poured is loaded on the metal frame 6 by means of a clamp 22 through the outer plate 20. The sand section 21 serves to slowly cool the finally solidified portion of molten metal poured into the mold and to collect casting defects such as shrinkage cavities or the like on the upper portion of the cast product.

The mold shown in FIG. 1 is a structure with chiller blocks stacked throughout the entire longitudinal length of the lateral mold section 5 and core 2, but the invention is not limited thereto and it may employ such a structure that the stacks of chiller blocks are provided only on the inner surface of the lateral mold section 5 and on the outer surface of the core 2 which come into contact with molten metal.

A preferable casting method of using the mold shown in FIG. 1 will now be described in below.

First, a fluid such as air or nitrogen gas is fed under pressure through a supply source (not shown) into the pipe 11a of the lateral mold section 5 and the pipe 11b of the core. However, the fluid may be also fed through the supply source into the pipe 10a or pipe 10b. A leakage of the gas due to a defect in the piping, if present, can be easily detected by checking the gas pressure. The reason of checking leakage in the piping is to prevent the danger at the next step, where explosion may be caused by any water leaking through the piping coming into contact with molten metal.

After confirmation of the absence of gas leakage, molten cast iron is teemed into the mold cavity 24 through the upwardly directed sprue 13. When the pouring of molten cast iron has been completed, the gas pressure is again checked to see if the piping may be damaged by the heat of molten metal.

Then, cooling water is fed through a supply source (not shown) into the pipes 11a and 11b to rapidly cool the molten metal. However, the water may be also fed through the supply source into the pipe 10a or 10b. The volume of cooling water is controlled, corresponding to the size and shape of the product to be cast, to suitably provide the cooling speed and solidification time of the product. The supply of water is continued until completion of solidification of the molten metal.

As soon as the solidification of molten metal is completed, the supply of water is stopped and the water in the pipes 11a and 11b and the pipes 10a and 10b is discharged by means of a pump (not shown). The passage of air in these pipes is shut off by closing valves (not shown), thereby serving the cooling pipes as heat insulating pipes, so that the matrix of cast iron product is increasingly ferritized by slowly cooling the solidified cast iron material to obtain the cast product having high strength and toughness.

By this method, solidification proceeds from the thickened bottom, and it becomes possible to reduce the solidification time for the midpoint of the thickened portion to about $\frac{1}{4}$ of that in the case of sand molds. As a result, the quality of the product becomes uniform and the casting defects can be prevented. Further, since the finally solidified portion exists on the upper portion of the cast product, the yield of casting is increased as compared to the case where a hollow product with bottom is cast with its bottom turned to up.

German Pat. Nos. DE 3216327C1 and DE 3120221C2 disclose a static casting mold comprising a lateral mold section and a core both provided with cooling pipes, the core standing on a lower mold section and the mold being provided at the upper portion thereof with a riser gate. Therefore, the riser gate portion is large and the yield of casting is extremely poor. The prior arts also differ in that the lateral mold section comprises a sand mold while the inner periphery of the lateral mold section according to the present invention comprises a composite structure for cooling.

An example of the present invention and an example of the prior arts will be shown as follows.

Figure 6:
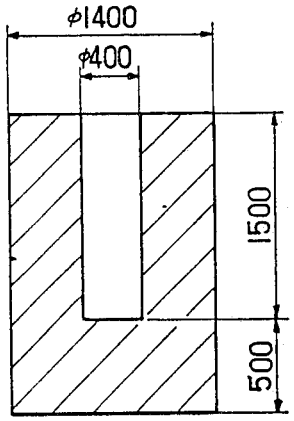
FIG. 6 is a longitudinal sectional view of a hollow product with bottom.

(1) Close-ended cylindrical cast products (weighing 20.5 ton) shown in FIG. 6 were cast by using the static mold of the present invention shown in FIG. 1 and also the static mold in the form of the conventional sand mold. The unit used in FIG. 6 is millimeter (mm).

(2) The molten metal used was spheroidal graphite cast iron, and was cast at temperature of 1300°±10° C. The composition of the molten metal is as follows; the value is given in terms of % by weight, and the balance being substantially Fe.

| | |
|---|---|
| C: 3.6% | P: 0.021% |
| Si: 2.3% | S: 0.008% |
| Mn: 0.18% | Mg: 0.06% |

(3) In the prior art example, it took about 10 hours until completion of solidification, whereas in the example of the present invention the time required until completion of solidification was ¼ of that for the prior art example. Further, no crack occurred in the example of the invention.

(4) Test pieces were sampled from an example of the invention and the prior art example, and were examined for their mechanical properties and metallic structure.

The test pieces were sampled at two locations in each of the cast product at the middle of its height; one 50 mm deep from the outer surface and the other in the midpoint of the thickness.

The test results for mechanical properties are given in Table 1.

TABLE 1

| | Tensile strength | | Yield strength | | Elongation |
|---|---|---|---|---|---|
| | (kg/mm²) | (× 10⁶Pa) | (kg/mm²) | (× 10⁶Pa) | (%) |
| Example of the Invention | | | | | |
| 50 mm deep from outer surface | 39.0 | (382.2) | 25.5 | (249.9) | 24.0 |
| Midpoint of thickness | 38.2 | (374.4) | 25.7 | (251.9) | 15.0 |
| Example of the Prior Art | | | | | |
| 50 mm deep from outer surface | 40.6 | (397.9) | 25.5 | (249.9) | 20.5 |
| Midpoint of thickness | 30.8 | (301.8) | 24.2 | (237.2) | 5.0 |

It is seen from Table 1 that in the example of the invention, the mechanical properties are almost identical in both the interior and the exterior of the cast product, whereas in the prior art example using the conventional sand mold the properties considerably vary in both the interior and the exterior of the product, particularly, the elongation varies as much as 4 times.

Figure 8:
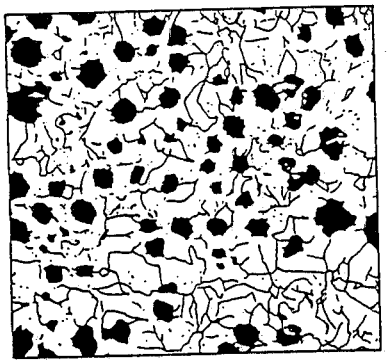
FIG. 8 illustrates the micro structure of outer surface portion of the product as cast by the mold according to the present invention.
Figure 9:
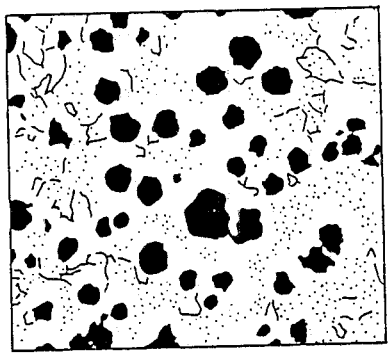
FIG. 9 illustrates the micro structure of wall midpoint portion of the product as cast by the mold according to the present invention.

FIGS. 8 and 9 are photomicrographs (x100) of the cast structure of the example of the invention, wherein FIG. 8 shows the microstructure at a 50 mm position inside the outer surface and FIG. 9 shows the micro structure at the midpoint of the thickness. A comparison of the two structures indicates that the portion of the cast product nearer to its outer side has a fine structure and the interior a coarse structure but that both exhibit a spheroidal graphite structure, thus evidencing the fact that there was little difference between the two in Table 1 with respect to mechanical properties.

Figure 10:
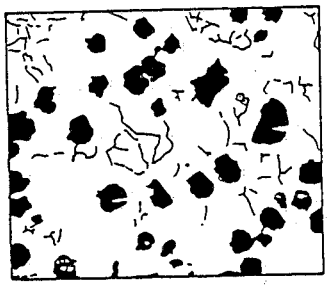
FIG.10 PRIOR ART
FIG. 10 illustrates the micro structure of outer surface portion of the product as cast by the conventional sand mold.
Figure 11:
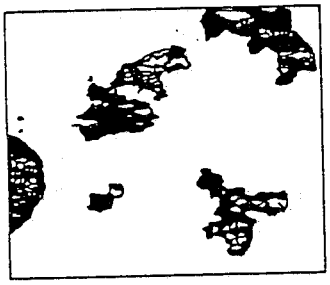
FIG.11 PRIOR ART
FIG. 11 illustrates the micro structure of wall midpoint portion of the product as cast by the conventional sand mold.

FIGS. 10 and 11 are photomicrographs (x100) of the cast structure of the example of the prior art, wherein FIG. 10 shows the microstructure at a 50 mm position inside the outer surface and FIG. 9 shows the microstructure at the midpoint of the thickness. The structure of the midpoint portion is not a spheroidal graphite one, there being seen therein considerably coarsened graphite and compacted vermicular graphite. From the microstructure of FIGS. 10 and 11, it will be understood that in Table 1 the mechanical properties remarkably varied in both the interior and the exterior of the cast product.

According to the static casting mold of the present invention, the outer mold section is formed at the inner lateral wall surface thereof by stacking chiller blocks and interposing therebetween refractory sand layers, so that each of the chiller blocks is free to exapand with heat. Accordingly, the inner surface of the outer mold section, irrespective of its increased cooling effect, can be prevented from large deformation and further from cracks on the cast product which will be caused by such large deformation.

Cooling effect on the molten metal will be further increased by providing the stacks of chiller blocks and refractory material layers also at the outer wall portion of the core and at the upper surface portion of the lower mold section, in like manner as that for the outer mold section.

Further, since cooling pipes are provided adjacent the chiller members, the cooling speed and solidfication time of cast products can be controlled as desired, so that the desired cast structure can be obtained even if the cast product is large-sized.

It should be understood that various modifications will be readily made by the skilled in the art without departing from the scope as defined in the accompanied claims.

What is claimed is:

1. A casting method for a hollow cast product having a bottom by utilizing a static casting mold comprising a top lid, a core and an outer mold section, the core being attached to the top lid and disposed inside the outer mold section, the outer mold section including a lateral mold section and a lower mold section having an upwardly directed sprue, the lateral mold section being formed at its inner peripheral wall portion with a composite cooling section by stacking chiller blocks and interposing therebetween refractory sands and at its outer wall portion with refractory sands, cooling pipes extending longitudinally through the inner wall portion and being in contact with at least a part of each of the chiller blocks, comprising the steps of;

pouring molten metal through the upwardly directed sprue filling the entire casting cavity, feeding cooling water into the cooling pipes to rapidly cool the molten metal, wherein the supply of water is continued until completion of solidification of the molten metal, stopping the water supply immediately upon completion of solidification of molten metal, and immediately thereafter discharging the water remaining in the pipes.

2. The casting method as defined in claim 1 further comprising the step of feeding a gas under pressure into the cooling pipes and checking to see is there is any gas leakage in the piping before pouring the molten metal.

3. The casting method as defined in claim 1 further comprising the steps of feeding a gas under pressure into the cooling pipes, and checking to see if there is any gas leakage in the piping upon completion of pouring the molten metal which fills the entire casting cavity.

4. The casting method as defined in claim 1 further comprising the step of shutting off any flow of air in the cooling pipes after discharging the water remaining in the cooling pipes.

5. The casting method as defined in claim 2 further comprising the step of checking to see if there is any gas leakage in the piping upon completion of pouring the molten metal which fills the entire casting cavity.

6. The casting method as defined in claim 2 further comprising the step of shutting off any flow of air in the cooling pipes after discharging the water remaining in the cooling pipes.

7. The casting method as defined in claim 3 further comprising the step of shutting off any flow of air in the cooling pipes after discharging the water remaining in the cooling pipes.

* * * * *